United States Patent [19]

Gruden

[11] Patent Number: 4,738,181

[45] Date of Patent: Apr. 19, 1988

[54] REPETITIVE HIGH-CURRENT OPENING SWITCH FOR RAILGUNS

[75] Inventor: James M. Gruden, Dayton, Ohio

[73] Assignee: The United States of America as represented by the Secretary of the Air Force, Washington, D.C.

[21] Appl. No.: 861,899

[22] Filed: May 12, 1986

[51] Int. Cl.[4] ..... F41F 1/02

[52] U.S. Cl. ..... 89/8; 124/3; 200/11 R; 200/144 AP; 200/164 R; 200/279; 310/12

[58] Field of Search ..... 89/8; 200/11 G, 11 K, 200/275, 279, 165, 155 R, 164 R, 144 AP, 151, 11 R; 124/3; 310/11-14; 318/135

[56] References Cited

U.S. PATENT DOCUMENTS

| | | | |
|---|---|---|---|
| 2,402,422 | 6/1946 | Lindenblad | 200/279 X |
| 2,668,894 | 2/1954 | Coates | 200/279 |
| 3,030,460 | 4/1962 | Huetten et al. | 200/11 G |
| 3,048,670 | 8/1962 | Jackson | 200/11 G |
| 4,355,561 | 10/1982 | Kemeny et al. | 89/8 |
| 4,369,692 | 1/1983 | Kemeny | 89/8 |
| 4,426,562 | 1/1984 | Kemeny | 89/8 |
| 4,429,613 | 2/1984 | Deis et al. | 89/8 |
| 4,433,607 | 2/1984 | Kemeny | 89/8 |
| 4,534,263 | 8/1985 | Heyne et al. | 89/8 |
| 4,555,972 | 12/1985 | Heyne | 124/3 X |

FOREIGN PATENT DOCUMENTS

| | | | |
|---|---|---|---|
| L12672 | 2/1956 | Fed. Rep. of Germany | 200/279 |

OTHER PUBLICATIONS

J. P. Barber and T. J. Trzaska, "Repetitive Switching for Inductive Energy Storage", AFWAL-TR-8-2-2088, Aug. 1982.

T. McCormick and J. Barber, "A 500 kA Repetitive Opening Switch", Proceedings of the 3rd Symposium on Electromagnetic Launch Technology, Apr. 21-24, 1986, Austin, TX, pp. 169-174.

*Primary Examiner*—Deborah L. Kyle
*Assistant Examiner*—John E. Griffiths
*Attorney, Agent, or Firm*—Donald J. Singer

[57] ABSTRACT

A very low inductance, high current, repetitive opening switch for railguns. A specific embodiment has a circular rotor positioned behind the rails with its rotational axis coaxial with the railgun projectile path defined by the rails. The face of the rotor facing the rails has at least one conducting and at least one insulating region, each symmetric about a diameter of the rotor. A pair of current collectors, or brushes, are positioned against the rotor face so that the rotor, when rotating, will alternately conduct and insulate current between the current collectors as conducting or insulating rotor regions sweep past the brushes, thereby communicating current between the switch and the rails. A specific embodiment of the invention has the conducting region the shape of a diametric strip, or shorting bar, and each current collector substantially the shape of an annular segment. The current collectors are made as a plurality of conductive fingers. Stainless steel edges along the shorting bar increase the rate of rise of resistance as the switch commutates current to the rails. The rotor may be driven by a hollow shaft to allow breech loading of the projectiles through the rotor. Another embodiment forms the shorting bar as an undulating channel to allow maximum current while the switch is closed, but increasing the rate of rise of resistance as the switch begins to open.

15 Claims, 4 Drawing Sheets

REPETITIVE HIGH-CURRENT OPENING SWITCH FOR RAILGUNS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to high current opening switches, and more specifically to a very low inductance, repetitive, high current opening switch for railguns.

Railguns are actively being considered as a primary component of a space based ballistic missile defense system. One of the limiting components in a railgun system has been identified as the opening switch. The opening switch is required to conduct high currents for long periods of time and then quickly open to commutate current into the railgun. In addition, the opening switch must be able to operate repetitively.

Railguns operate by using a very high electric current to create a very strong magnetic field. The vector cross product of the magnetic field with the current is called a Lorentz force. The Lorentz force can be used to propel an electrically conducting projectile between a pair of electrically conducting rails. The projectile experiences several 100,000's of g's as it accelerates down the railgun barrel and can obtain muzzle velocities of several kilometers per second.

The very high railgun currents place tremendous energy dissipation demands on the opening switch. The amount of switching energy dissipated by the opening switch is primarily a function of the switch inductance. The prior art includes actual and proposed railgun opening switches of successively lower switch inductances, but even lower switch inductances will be required to increase the system efficiencies of space based rapid fire railguns.

It is thus seen that there is a need for a railgun opening switch of lower switch inductance than has been thus far known in the art.

It is, therefore, a principal object of the present invention to provide a very low inductance, repetitive, railgun opening switch.

It is a feature of the present invention that the switch does not have to be offset relative to the rails to allow breech loading of the railgun.

It is another feature of the present invention that commutation time is reduced by increasing the rate of rise in resistance as the switch opens.

It is an advantage of the present invention that not all fingers of the brush modules conduct current during all times of a closed switch cycle, increasing the duty life of the brush modules.

SUMMARY OF THE INVENTION

In accordance with the foregoing principles, objects, features and advantages of the present invention, a novel, very low inductance repetitive railgun opening switch is described comprising a rotor positioned behind the rails of a railgun and having its rotational axis substantailly coaxial with the projectile path defined by the rails. The face of the rotor facing the rails has at least one conducting and at least one insulating region, each symmetric about a diameter of the rotor. A pair of current collectors are positioned against the rotor face so that the rotor, when rotating, will alternately conduct and insulate current between the current collectors as conducting or insulating rotor regions sweep past the brushes.

The invention also includes having the conducting region the shape of a diametric strip along a diameter of the rotor and each current collector substantially the shape of an annular segment.

The invention further includes having the current collectors made of a plurality of conductive fingers.

The invention additionally includes edges along the dielectric conducting strip made from a less conductive material.

The invention also includes a hollow opening through the rotor and a rotor shaft to allow projectiles to pass through the rotor for loading.

The invention further includes forming the diametric conducting strip in the shape of an undulating channel extending from one long side of the conducting strip to the other long side.

DESCRIPTION OF THE DRAWINGS

The present invention will be more clearly understood from a reading of the following detailed description in conjunction with the accompaning drawings wherein.

DETAILED DESCRIPTION

Figure 1:
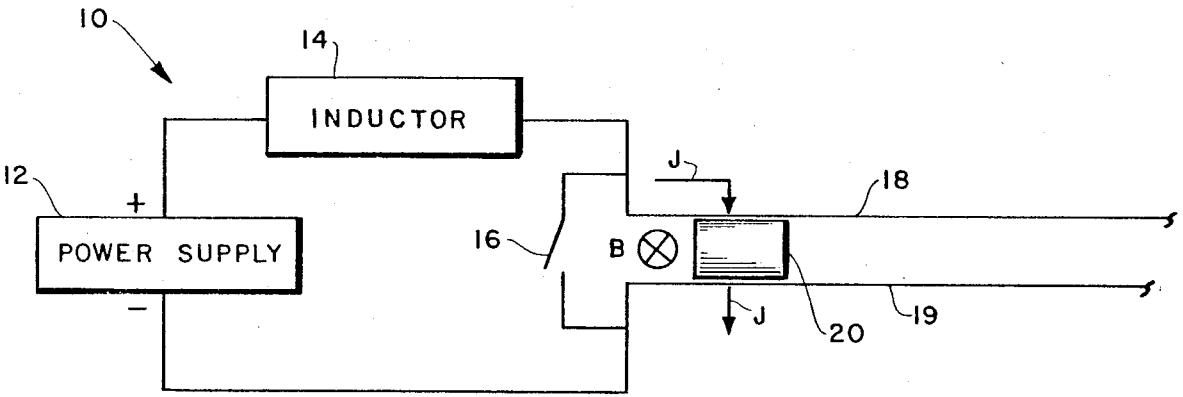
Fig. 1 PRIOR ART
FIG. 1 is a schematic of a typical prior art railgun circuit.

Referring now to FIG. 1, there is shown a typical prior art rail gun circuit 10. The problems to be solved in a railgun opening switch will be better understood from a more detailed understanding of the operation of a railgun. The circuit 10 comprises a power supply 12, an inductor 14, an opening switch 16, a pair of rails 18, 19 and a projectile 20. The opening switch 16 is located at the breech of the railgun and is normally closed. The closed switch 16 has a resistance substantially less than that of the alternate electrical path through the rails 18, 19 and the projectile 20. While closed, current from the power supply 12 flows through the inductor 14, storing large amounts of energy in the magnetic field of the inductor 14. When switch 16 is opened, the energy stored in the inductor is suddenly released through the rail-projectile-rail path at rates much faster than could be supplied by the power supply alone. Practical railgun circuits will develop megampere level currents. Current flowing along the rails in the conventional direction from positive to negative will, by application of the right hand rule, create a magnetic field B directed into the page to the left of projectile 20. The vector cross product of the downwardly directed current J passing through the projectile 20 with the magnetic field vector B produces a Lorentz force directed toward the rights, propelling the projectile 20 along the rails 18, 19.

The rapid fire capabilities imposed by present concepts for the use of space based railguns will require repetitive switching. Repetitive switching places tremendous energy dissipation requirements on the switch because the switch must dissipate the commutation, or switching, energy. The commutation energy is a function of the commutation inductance created by the circuit of the switch 16, rails 18, 19 and projectile 20. When the switch is opened, stored commutation energy must be either recovered, as in a counter pulse capacitor, or dissipated by arcing or resistance heating. The commutation energy is expressed as $\frac{1}{2} L_{com}I^2$, where $L_{com}$ is the commutation inductance (the sum of the switch $L_{sw}$ and load $L_{ld}$ inductances), and I is the current. With I fixed by the railgun power requirements in the range of several megamperes, a simple calculation shows that even an $L_{com}$ as low as 100 nanoHenrys (nH, where $n=10^{-9}$) results in a commutation energy of several hundred thousand joules, too high to allow a switch repetitively firing at 10 Hz to survive. Because both I and $L_{ld}$ are largely fixed in a railgun, the most effective means to reduce the required dissipation energy is to design the switch 16 to minimize the switch inductance. Additional calculations have shown that a minimum desired switch inductance is in the range of 10–20 nH. Inductance being a direct function of loop size, a practical railgun must have the size of the loop circuit formed by the switch 16, the rails 18, 19, and projectile 20 be made as small as possible.

Figure 2:
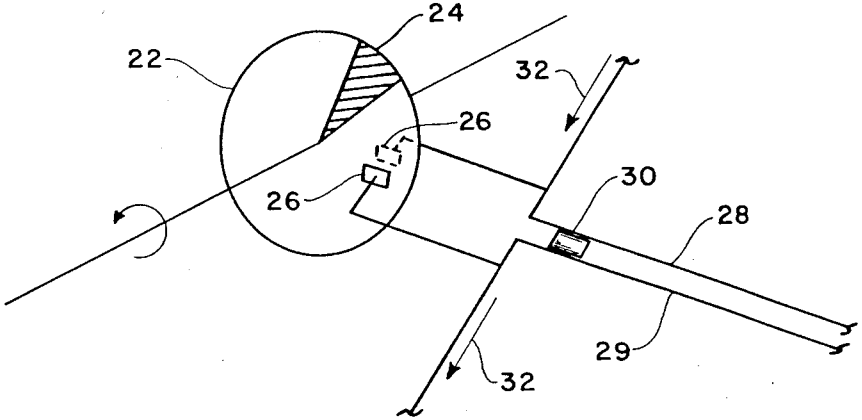
Fig. 2 PRIOR ART
FIG. 2 is a representational perspective view of a prior art rotating switch using a rotor.

There are other important design aspects of railgun switches in addition to switch inductance. Railgun switches must pass very high currents with a minimum of switch resistance. Possible solutions are made more difficult by the requirement of repetitive switching. One previous proposed solution uses a rotating switch concept as shown in FIG. 2. Rotor 22 is made of copper with two insulating regions 24 comprising epoxy inserts inside recesses machined into opposite faces of the rotor. Brushes 26 connect the rotor 22 to rails 28, 29 and projectile 30. As the rotor 22 rotates, the switch alternately closes, passing current 32 through the brushes, and quickly opens as insulating sections 24 pass between the brushes 26.

Simple inspection of the FIG. 2 switch shows how loop size has been minimized to reduce inductance. Unfortunately, this concept results in switch inductances still greater than will be needed for a practical and successful railgun.

Figure 3:
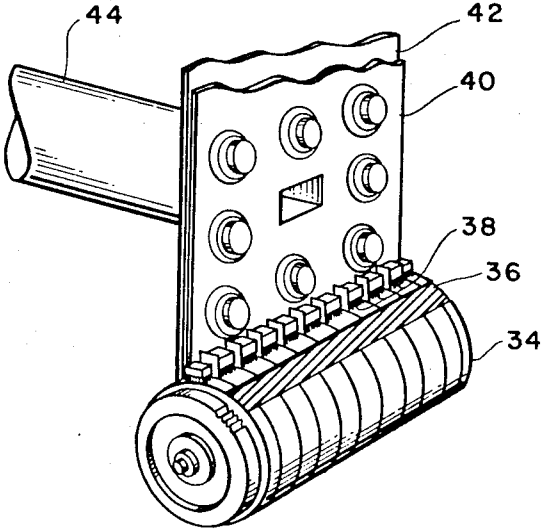
Fig. 3 PRIOR ART
FIG. 3 is a perspective view of a prior art rotating switch using a drum.

A further improvement in prior art railgun switch design is shown in FIG. 3. A rotating drum 34 replaces the rotor 22 of FIG. 2. The drum has an insulating section 36 and finger brushes 38. Finger brushes are well known in the art and are used in place of flat brushes because flat brushes make electrical contact only at high spots at varying locations on their surfaces. The fingers create deliberate high spots in both greater number and with more reliable conductivity than flat brushes. The positive bus 40 and the negative bus 42 have a very small separation and extend a short distance to a rail section 44, shown as a cylindrical enclosure. The enclosure is the outer part of an assembly for holding the actual rails in place. Without such an assembly, the Lorentz forces would force the rails apart. The drum 34 is not located directly behind the rail section 44 to allow breech access to the rail section 34 for loading. Inspection of FIG. 2 reveals that a final implementation of that concept will also require an offset placement to allow breech loading.

Inspection of the FIG. 3 switch shows that it also has a very low inductance, despite its offset position. Additionally, its finger brushes comprise tens of leaves laminated into substantially square and very efficient current collectors. The commutation inductance of this switch has been calculated, however, at approximately 28 nH, still higher than desired for a practical and successful space based railgun.

Figure 6:
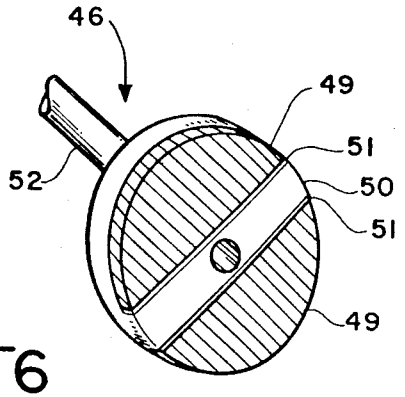
FIG. 6 is another perspective view of the rotor assembly of FIG. 4; and, FIG. 7 is a front view of a rotor incorporating a shorting bar comprising an undulating conductor.
Figure 4:
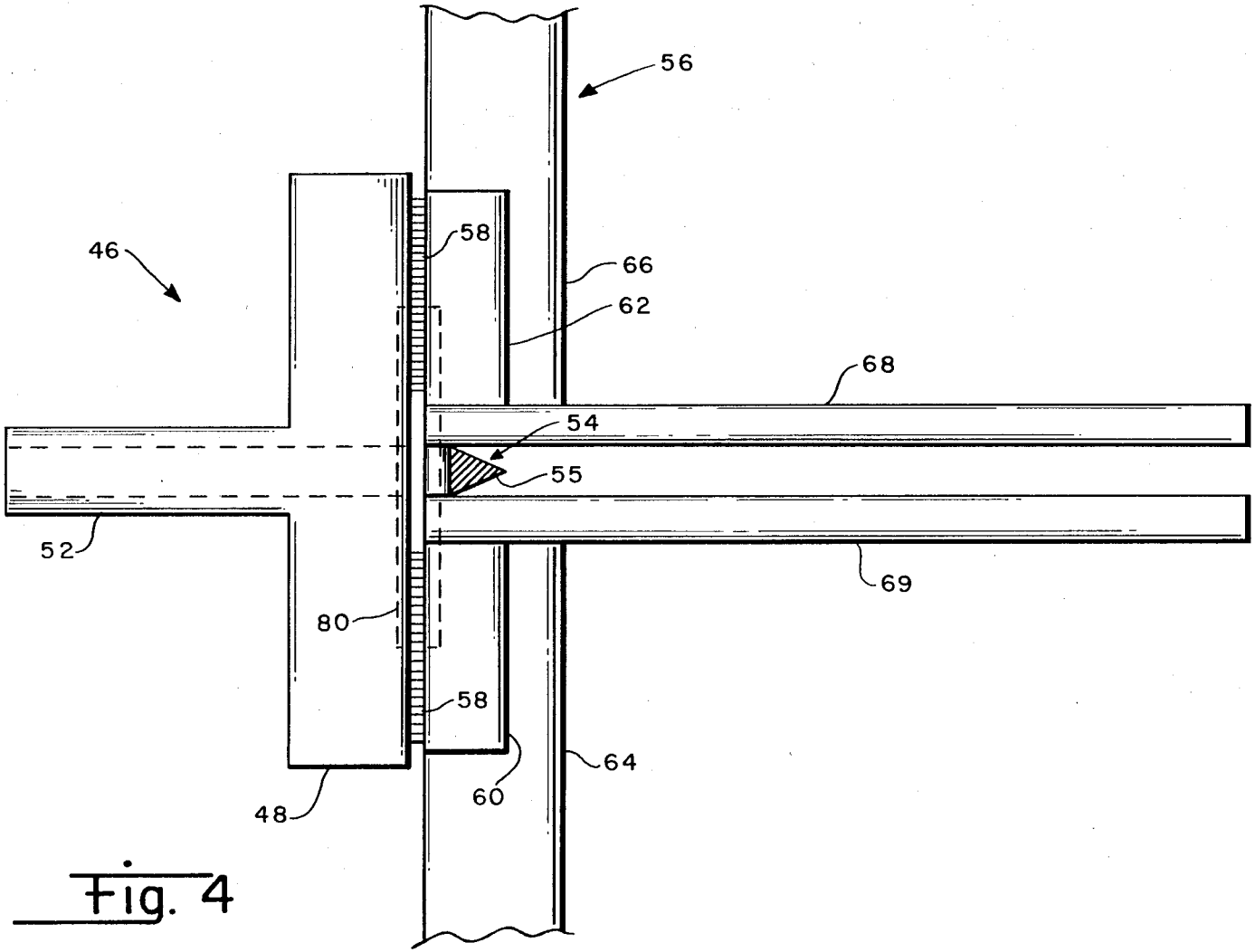
FIG. 4 is a cross-sectional view of a railgun with a rotating opening switch incorporating the teachings of the present invention.
Figure 5:
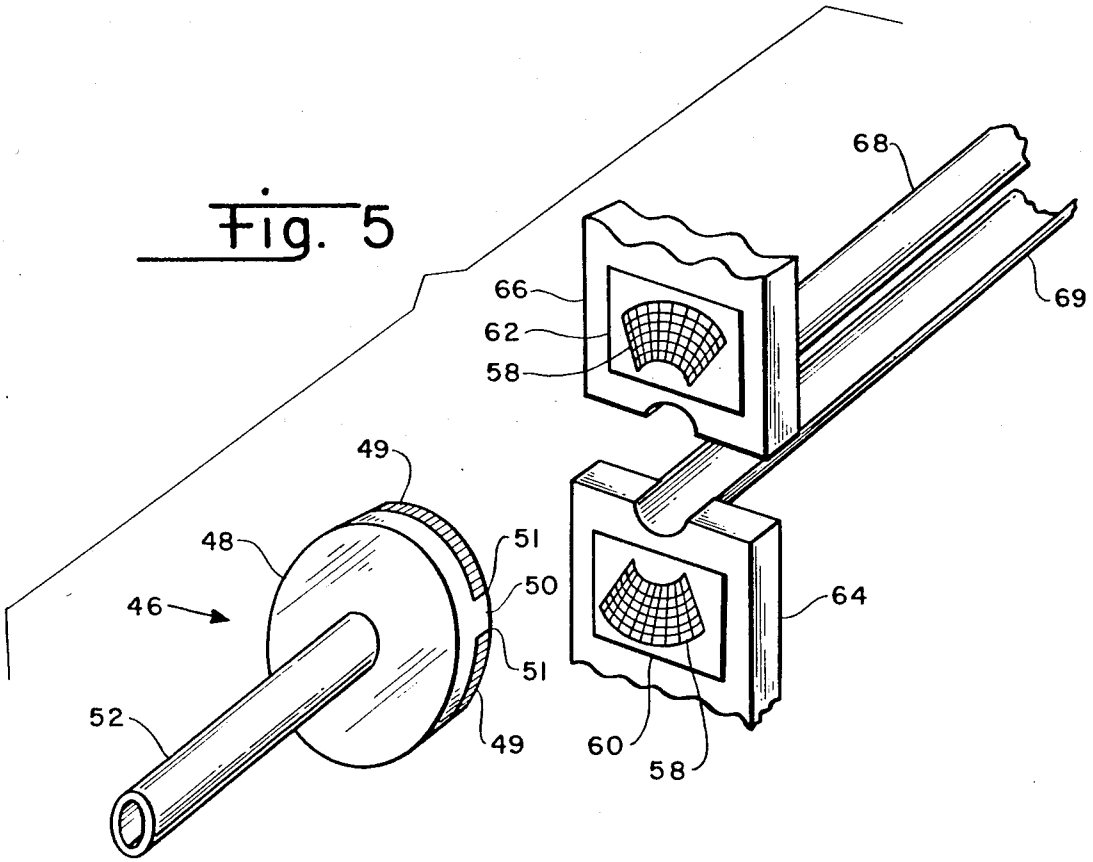
FIG. 5 is an exploded perspective view of the rotor, brush and rail assemblies shown in FIG. 4.

Referring now to FIG. 4 of the drawings, there is shown a cross-sectional view of a railgun having a rotating opening switch incorporating the teachings of the present invention. FIG. 5 is an exploded perspective view of the rotor, brush and rail assemblies of FIG. 4 to provide an easier understanding of the configurations and spatial relationships of the various elements shown in FIG. 4. FIG. 6 is another perspective view of the rotor assembly of FIG. 4.

The rotor 46 comprises a copper rotating disk 48 having on its front face two insulating regions 49. The insulating regions 49 comprise epoxy inserts inside recesses cut into the front face of rotating disk 48. The remaining exposed copper on the front face of disk 48 forms a diametric conducting strip 50. The rotor includes a shaft 52, which may be hollow to allow breech loading of a projectile 54. Projectile 54 includes a nonconducting section 55, which may simply comprise additional mass to increase throw weight, or may include electronic and other controls. The edges of conducting strip 50 are trimmed with a small thickness of stainless steel 51, or other higher resistance material, to assist during commutation. The brush assembly 56 comprises finger brushes 58 (shown representively by cross-hatching in FIG. 5) mounted in brush modules 60 and 62, which are in turn mounted on a negative bus bar 64 and on a positive bus bar 66. The bus bars are conductively connected to rails 68, 69.

The operation of the opening switch will be understood by inspection of the drawings along with the following description. Current is alternately conducted through the switch and commutated into the rails 68, 69, as rotating conducting strip 50 simultaneously sweeps across the finger brushes 58, then past their edges, then again across the brushes 58, and then repeating. Unlike other rotary switches, only a portion of the fingers of brushes 58 conduct current at any given time, decreasing wear on the fingers and prolonging switch life.

As the edges of conducting strip 50 begin to sweep past the brushes 58 to commutate the switch current into the rails 68, 69, the less conductive stainless steel edges 51 begin to carry most of the current, thereby assisting in increasing the rate of rise in resistance, and therefore the rate of commutation.

The commutation inductance is indicated by the dashed line 80. The clear improvement in reduced switch inductance compared with the prior art is shown by visual comparison of the present invention with the prior art opening switches of FIGS. 2 and 3.

Those skilled in the art will recognize that the use of a hollow shaft 52 can allow the projectile 54 to be preaccelerated before entering the railgun breech. Rifling the inside of the shaft 52 can impart, if desired, a rotation to the projectile.

Those skilled in the art will also recognize that changes may be made in the shape and arrangement of the conducting and non-conducting regions of rotating disk 48 without adversely affecting the operation of the switch. For example, the length of conducting strip 50 may be less than the diameter of disk 48 with a single insulating region surrounding it on all sides. The rotor may be non-circular and may include insulating regions and diametric conducting regions of various shapes and configurations to improve and vary various switch performance parameters. Additional elements may be added to the opening switch to improve or alter its performance. For example, the insulating regions may include rollers to minimize mechanical friction losses while passing over the finger brushes.

Figure 7:
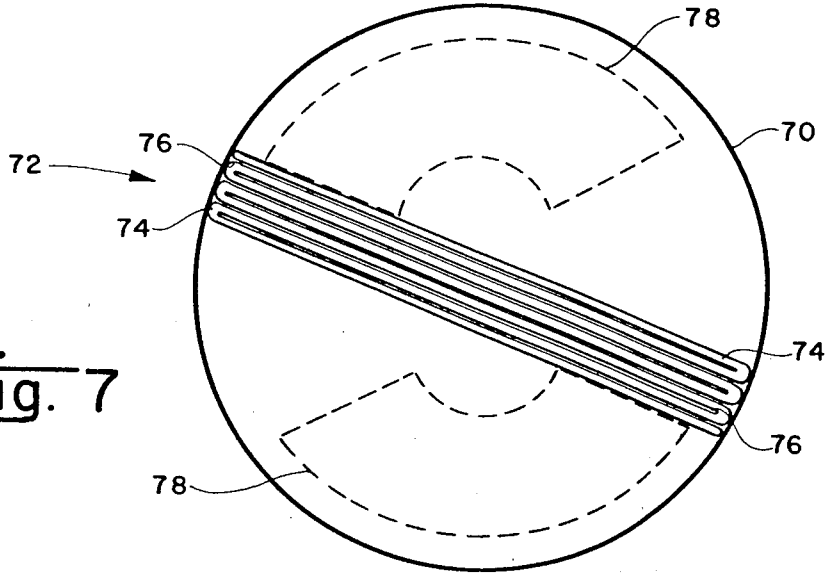

Referring now to FIG. 7, there is shown a front view of a rotor 70 incorporating a conducting strip 72 comprising an undulating, or serpentine, conducting channel 74 extending from one long side of conducting strip 72 to the other long side. A dashed line outline 78 of brushes 58 is overlaid on the image of rotor 70. The conducting channel 74 extends completely through the rotor from the front to the rear face. The spaces 76 between the conducting channels 74 comprise insulating material. A supporting plate, not visible in this figure, bolts to the rear face of the rotor to provide structural strength to the rotor weakened by the presence of spaces 76.

Conducting channel 74 provides, as does the stainless steel edges 51 in FIGS. 5 and 6, a faster rise in resistance as the edges of the conducting strip begin to sweep past the brushes. When conducting strip 72 is in complete contact with the brushes, current flows along all the parallel paths of conducting channel 74, presenting minimun resistance to current. As the edges of conducting strip 72 begin to sweep past the edges of the brushes, the current path become restricted to the longer path through the conducting channel 74, rapidly increasing resistance and the rate of commutation.

It is understood that certain modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. An high-current opening switch, comprising:

(a) a rotor having a front face and a rear face, the rotor being comprised substantially of conducting material;

(b) a layer of insulating material covering at least one region of the front face of the rotor, the region symmetric about a diametric line of the rotor;

(c) a pair of current collectors positioned against the front rotor face, each current collector positioned on opposite sides of the rotor rotational axis (d) wherein the area of the front face of the rotor not covered by said layer of insulating material defines a conducting region having a shape symmetric about a diametric line of the rotor and subtending a smaller arc than each of the pair of current collectors (e) an opening through the rotor along its rotational axis, wherein the opening substantially remains open during operation of the switch.

2. The opening switch according to claim 1, further comprising a hollow shaft attached to the rear face of the rotor coaxial with the rotor rotational axis.

3. The opening switch according to claim 1, wherein the front face of the rotor includes a depression beneath said layer of insulating material for locating the insulating material so that the entire front face of the rotor is substantially flat.

4. The opening switch according to claim 1, wherein:

(a) the conducting region defines substantially the shape of a diametric strip; and, (b) each current collector defines substantially the shape of an annular segment.

5. The opening switch according to claim 4, wherein each current collector comprises a plurality of conductive fingers.

6. The opening switch according to claim 4, wherein the conducting region includes edge inserts made from material of lower conductivity than the rest of the conducting region.

7. The opening switch according to claim 1, wherein the conducting region has the outside shape of a diametric strip and further defines a narrow channel of said rotor conducting material having an undulating path from one long side of said diametric strip to the other long side.

8. A railgun, comprising:

(a) means for supplying current;

(b) an inductor electrically connected to the current supplying means;

(c) a pair of rails, one each electrically connected to the current supplying means and to the inductor;

(d) a projectile for being propelled along a path defined by the rails;

(e) an opening switch, said opening switch having a rotor having its rotational axis substantially coaxial with the projectile path defined by the rails, the rotor further having a front face toward the rails and a rear face on the opposite side of the rotor;

(f) wherein the front rotor face includes at least one conducting region and at least one insulating region, each region symmetric about a diametric line of the rotor; and, (g) a pair of current collectors positioned against the front rotor face, each current collector positioned on opposite sides of the rotor rotational axis and each current collector electrically connected to a separate rail.

9. The railgun according to claim 8, wherein;

(a) said conducting region defines the shape of a diametric strip; and, (b) each current collector of the pair of current collectors defines substantially the shape of an annular segment.

10. The railgun according to claim 9, wherein each current collector of the pair of current collectors comprises a plurality of conductive fingers.

11. The railgun according to claim 9, wherein the conducting region includes edge inserts made from material of lower conductivity than the rest of the conducting region.

12. The railgun according to claim 9, wherein the conducting region comprises a narrow channel of conducting material extending through the rotor and defining an undulating path from one long side of the conducting strip to the other long side.

13. The railgun according to claim 8, wherein the rotor has an opening along its rotational axis to allow the passage of the projectile through the rotor.

14. The railgun according to claim 13, further comprising a hollow shaft attached to the rear rotor face coaxial with the rotor rotational axis.

15. The railgun according to claim 14, wherein the inside of said hollow shaft is rifled.

* * * * *

UNITED STATES PATENT AND TRADEMARK OFFICE

CERTIFICATE OF CORRECTION

PATENT NO. : 4,738,181

DATED : April 19, 1988

INVENTOR(S) : James M. Gruden

It is certified that error appears in the above-identified patent and that said Letters Patent is hereby corrected as shown below: Title page:

In the Abstract, line 12, change "communicating" to ---commutating---.

In Column 2, line 13, change "dielectric" to ---diametric---.

In Column 3, line 2, change "rights" to ---right---.

In Claim 1, column 5, line 46, delete "high-current".

Signed and Sealed this

Twenty-first Day of February, 1989

*Attest:*

*Attesting Officer*

DONALD J. QUIGG

*Commissioner of Patents and Trademarks*